US010557180B2

(12) United States Patent
Katsumata

(10) Patent No.: US 10,557,180 B2
(45) Date of Patent: Feb. 11, 2020

(54) HEAT TREATING DEVICE

(71) Applicants: IHI Corporation, Tokyo (JP); IHI Machinery and Furnace Co., Ltd., Tokyo (JP)

(72) Inventor: Kazuhiko Katsumata, Inuyama (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 205 days.

(21) Appl. No.: 15/716,707

(22) Filed: Sep. 27, 2017

(65) Prior Publication Data

US 2018/0016651 A1 Jan. 18, 2018

Related U.S. Application Data

(63) Continuation of application No. PCT/JP2016/056964, filed on Mar. 7, 2016.

(30) Foreign Application Priority Data

May 1, 2015 (JP) ..... 2015-094167

(51) Int. Cl.

| | |
|---|---|
| ***C21D 1/06*** | (2006.01) |
| ***C21D 1/76*** | (2006.01) |
| ***C23C 8/26*** | (2006.01) |
| ***C22C 38/00*** | (2006.01) |
| ***C23C 8/22*** | (2006.01) |
| ***C23C 8/32*** | (2006.01) |
| ***C23C 8/80*** | (2006.01) |
| *F27D 17/00* | (2006.01) |

(52) U.S. Cl.

CPC ..... *C21D 1/06* (2013.01); *C21D 1/76* (2013.01); *C22C 38/001* (2013.01); *C23C 8/22* (2013.01); *C23C 8/26* (2013.01); *C23C 8/32* (2013.01); *C23C 8/80* (2013.01); *F27D 17/003* (2013.01); *F27D 17/004* (2013.01); *F27D 17/008* (2013.01)

(58) Field of Classification Search

CPC .... C23C 8/22; C23C 8/80; C23C 8/26; C23C 8/32; C21D 1/06; C21D 1/76

See application file for complete search history.

(56) References Cited

U.S. PATENT DOCUMENTS

| | | | | |
|---|---|---|---|---|
| 1,915,120 | A * | 6/1933 | Burke | C01B 3/025 252/374 |
| 4,309,227 | A * | 1/1982 | Kajikawa | C23C 8/38 148/222 |
| 5,865,908 | A | 2/1999 | Takei et al. | |
| 6,024,893 | A | 2/2000 | Keil et al. | |

FOREIGN PATENT DOCUMENTS

| | | | |
|---|---|---|---|
| CN | 203402922 | U | 1/2014 |
| CN | 203612947 | U | 5/2014 |
| JP | 62-175069 | U | 11/1987 |
| JP | 3-105194 | A | 5/1991 |
| JP | 10-306364 | A | 11/1998 |
| JP | 2002-239341 | A | 8/2002 |
| JP | 2009-186140 | A | 8/2009 |
| JP | 2010-7128 | A | 1/2010 |
| JP | 2012-192349 | A | 10/2012 |
| JP | 5577573 | B2 | 8/2014 |

OTHER PUBLICATIONS

Liu, Yubao, "Heat treatment that can control the atmosphere," (with an English translation from pp. 86 to 87) (11 pages).

"Safety Precautions," Metals Handbook, American Society of Metals, 9th Edition, vol. 4, Dec. 1988, pp. 378-379, 5 pages.

Chinese Office Action issued in Application No. 201680025014.6, dated Mar. 12, 2019, 9 pages with partial English translation.

* cited by examiner

*Primary Examiner* — Jessee R Roe

(74) *Attorney, Agent, or Firm* — Rothwell, Figg, Ernst & Manbeck, P.C.

(57) ABSTRACT

The present disclosure is characterized by inexpensively treating an ammonia gas contained in an exhaust gas after nitriding without performing combustion, adsorption using an adsorption agent, or the like. A vacuum carburizing device of the present disclosure includes a heating furnace which heats a workpiece, an ammonia gas supply device which supplies an ammonia gas and nitrides the workpiece to the heating furnace, and a thermal decomposition furnace which thermally decomposes the ammonia gas discharged from the heating furnace after nitriding.

10 Claims, 5 Drawing Sheets

HEAT TREATING DEVICE

CROSS-REFERENCE TO RELATED APPLICATION

This application is a continuation application based on PCT Patent Application No. PCT/JP2016/056964, filed on Mar. 7, 2016, whose priority is claimed on Japanese Patent Application No. 2015-094167, filed on May 1, 2015. The contents of both the PCT Patent Application and the Japanese Patent Applications are incorporated herein by reference.

TECHNICAL FIELD

The present disclosure relates to a heat treating device.

BACKGROUND ART

In a case where hardness is required on a surface of a workpiece, generally, carburizing or the like is performed. In addition, in the case where hardness higher than the hardness is required, nitriding may be performed on the surface. For example, as a heat treating device which performs the nitriding, a vacuum carburizing device disclosed in Patent Document 1 below is known. In the vacuum carburizing device, carburizing consists of supplying a carburizing gas such as acetylene and a diffusion treatment of diffusing carbon of the carburizing gas on the surface of the workpiece are performed, in the diffusion treatment, a nitriding gas is supplied so as to form a nitrided layer on the surface of the workpiece, and surface hardness or wear resistance of the workpiece is improved.

CITATION LIST

Patent Document

[Patent Document 1] Japanese Patent No. 5577573

SUMMARY

Technical Problem

Meanwhile, as a nitriding gas in nitriding, an ammonia gas is often used. The ammonia gas is a deleterious substance with a high irritancy, and it is necessary to appropriately treat the ammonia gas discharged from a heating furnace after the nitriding. As a treatment method of the ammonia, a combustion method of combusting the ammonia gas has been performed for a long time. In the combustion method, since there are problems with respect to regulation of combustion waste gas, or the like, in recent years, treatments such as dissolving the combusted ammonia gas in water or adsorbing the ammonia gas by adsorbent are performed. However, the running cost of equipment which performs the treatments is very expensive.

The present disclosure is made in consideration of the above-described problems, and an object thereof is to provide a heat treating device which can inexpensively treat an ammonia gas used in nitriding.

Solution to Problem

In order to achieve the above-described object, according to a first aspect of the present disclosure, there is provided a heat treating device, including: a heating furnace which heats a workpiece; an ammonia gas supply device which supplies an ammonia gas which nitrides the workpiece to the heating furnace; and a thermal decomposition furnace which thermally decomposes the ammonia gas discharged from the heating furnace after nitriding.

In the present disclosure, the thermal decomposition furnace is juxtaposed with the heating furnace which performs the nitriding, and the ammonia gas discharged from the heating furnace after the nitriding is thermally decomposed in the thermal decomposition furnace. In the thermal decomposition furnace, since the ammonia gas is decomposed by heating, a combustion waste gas is not discharged, and water for treating the ammonia gas is not required and replacement or replenishment of an absorbent or the like is not required.

Therefore, according to the present disclosure, the heat treating device which can inexpensively performs treatment of the ammonia gas is obtained.

DESCRIPTION OF EMBODIMENTS

Hereinafter, embodiments of the present disclosure will be described with reference to the drawings. In addition, in the following descriptions, a vacuum carburizing device is exemplified as a heat treating device of the present disclosure.

First Embodiment

Figure 1:
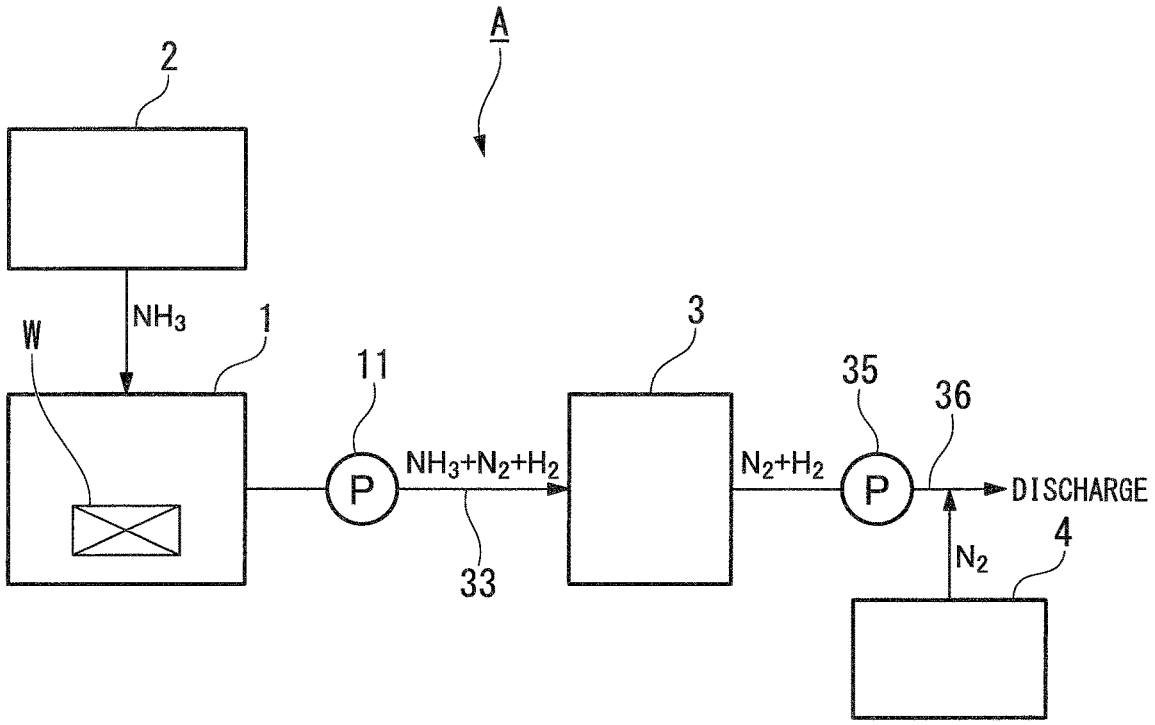
FIG. 1 is a block diagram showing a schematic configuration of a vacuum carburizing device according to a first embodiment of the present disclosure.

FIG. 1 is a block diagram showing a schematic configuration of a vacuum carburizing device A according to the first embodiment of the present disclosure.

As shown in FIG. 1, the vacuum carburizing device A of the present embodiment includes a heating furnace 1, an ammonia gas supply device 2, a thermal decomposition furnace 3, and a nitrogen gas supply device 4.

The heating furnace 1 heats a workpiece W. The heating furnace 1 of the present embodiment is a vacuum carburizing furnace to which a vacuum pump 11 is connected, and performs vacuum carburizing/nitriding on the workpiece W formed of a steel material. A heater (not shown) or the like is disposed inside the heating furnace 1. In addition, a carburizing gas supply device (not shown) is connected to the heating furnace 1, and for example, an acetylene gas ($C_2H_2$) is supplied as a carburizing gas. The ammonia gas supply device 2 supplies an ammonia gas ($NH_3$) which nitrides the workpiece W to the heating furnace 1.

Figure 2:
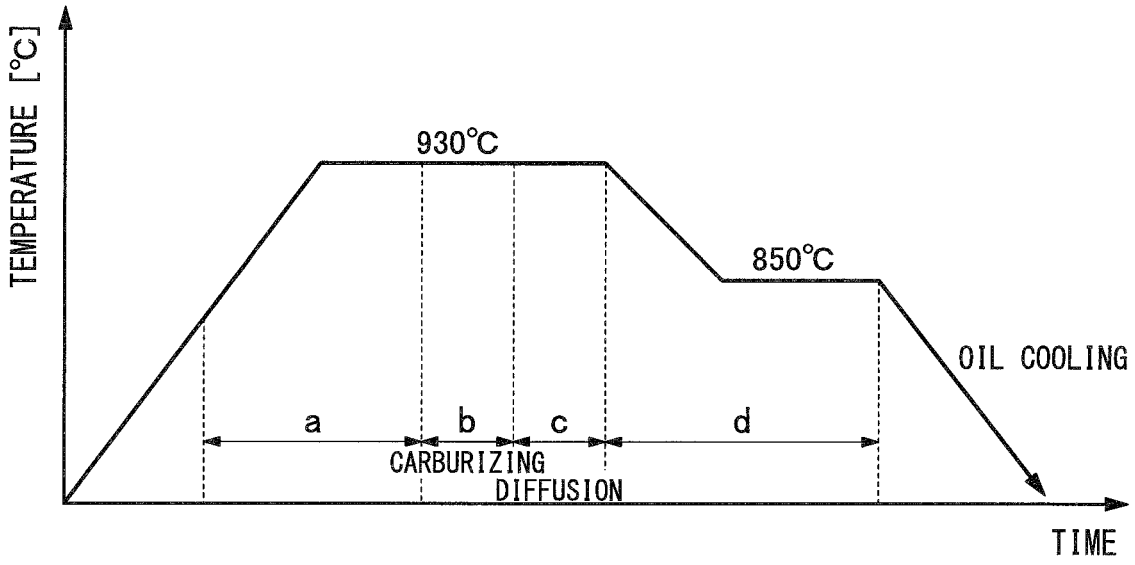
FIG. 2 is a view showing a profile of a treatment time and a treatment temperature of vacuum carburizing and nitriding according to the first embodiment of the present disclosure.

FIG. 2 is a view showing a profile of a treatment time and a treatment temperature of the vacuum carburizing and nitriding according to the first embodiment of the present disclosure.

As shown in FIG. 2, in a heat treatment of the workpiece W of the present embodiment, a: a temperature increase and a temperature increase holding step, b: carburizing step, c: diffusion step, and d: a temperature decrease and a temperature decrease holding step are performed in this order, and finally, oil cooling is performed.

In the heat treatment of the present embodiment, first, the workpiece W is placed inside the heating furnace 1. Next, the inside of the heating furnace 1 is evacuated, and the inside of the heating furnace 1 decompresses and enters a vacuum state (extremely low pressure atmosphere). Here, in general vacuum carburizing, "vacuum" means approximately 1/10 or less of the atmospheric pressure. In the present embodiment, the inside of the heating furnace 1 is a vacuum state of 1 kPa or less, and preferably, 1 Pa or less.

Next, in the temperature increase and the temperature increase holding step, power is supplied to the heater of the heating furnace 1, and the temperature inside the heating furnace 1 increases to a target temperature (in the present embodiment, 930° C.). Subsequently, the state where the temperature inside the heating furnace 1 is the target temperature is held for a predetermined time. Since the holding time is provided, the temperature of the workpiece W sufficiently and easily follows the temperature of the heating furnace 1. As a result, it is possible to accurately control the temperature when the step is transferred to the next carburizing step.

Subsequently, in the carburizing step, an acetylene gas is supplied into the heating furnace 1 as a carburizing gas. In this case, the pressure inside the heating furnace 1 increases from the vacuum state to a predetermined pressure. In this carburizing step, the workpiece W is exposed to a carburizing gas atmosphere having a high temperature such as 930° C. in the heating furnace 1 for a predetermined time, and the carburizing is performed.

Subsequently, in the diffusion step, the carburizing gas is discharged from the inside of the heating furnace 1, and the state becomes the vacuum state having approximately the same pressure as that before the carburizing step. Subsequently, in the temperature decrease and the temperature decrease holding step, the temperature inside the heating furnace 1 is decreased to a target temperature (in the present embodiment, 850° C.) by controlling the heater of the heating furnace 1. Continuously, the state where the temperature inside the heating furnace 1 is the target temperature is held for a predetermined time. In this case, first, a nitrogen gas ($N_2$) is supplied to the heating furnace 1, and after the pressure is increased to a target pressure, an ammonia gas is supplied into the heating furnace 1. If the ammonia gas is supplied into the heating furnace 1, an ON/OFF control of an evacuation circuit is performed such that the control is performed in a state where the pressure of the heating furnace 1 is a constant pressure. In this case, a fan (not shown) for agitating the atmosphere inside the heating furnace 1 is operated.

Accordingly, carbon which enters the vicinity of the surface of the workpiece W is diffused from the surface of the workpiece W to the inside of the workpiece W. In addition, a portion of the ammonia gas which is exposed to the high-temperature atmosphere inside the heating furnace 1 for a predetermined time is thermally decomposed, and a nitrogen gas ($N_2$) and a hydrogen gas ($H_2$) are generated. Since the treatments in the diffusion step and the temperature decrease and the temperature decrease holding step are performed under a nitrogen gas (including a hydrogen gas and an ammonia gas) atmosphere, a nitrided layer (for example, $Fe_4N$ or the like) is formed on the surface of the workpiece W, and surface hardness or wear resistance of the workpiece W is improved. That is, the diffusion step and the temperature decrease and the temperature decrease holding step correspond to a nitriding step.

Thereafter, the workpiece W is transferred to a cooling tank (not shown), and oil cooling performs on the workpiece W from a high temperature of 850° C. to a normal temperature. In the above-described steps, the vacuum carburizing/nitriding of the present embodiment are completed. According to the heat treatment of the present embodiment, improvement of hardenability can be expected by addition of the nitriding gas in the diffusion step and the temperature decrease and the temperature decrease holding step.

Return to FIG. 1, the thermal decomposition furnace 3 thermally decomposes the ammonia gas discharged from the heating furnace 1 after the vacuum carburizing/nitriding. In addition, a portion of the ammonia gas discharged from the heating furnace 1 is thermally decomposed and includes a nitrogen gas ($N_2$) and a hydrogen gas ($H_2$).

Figure 3:
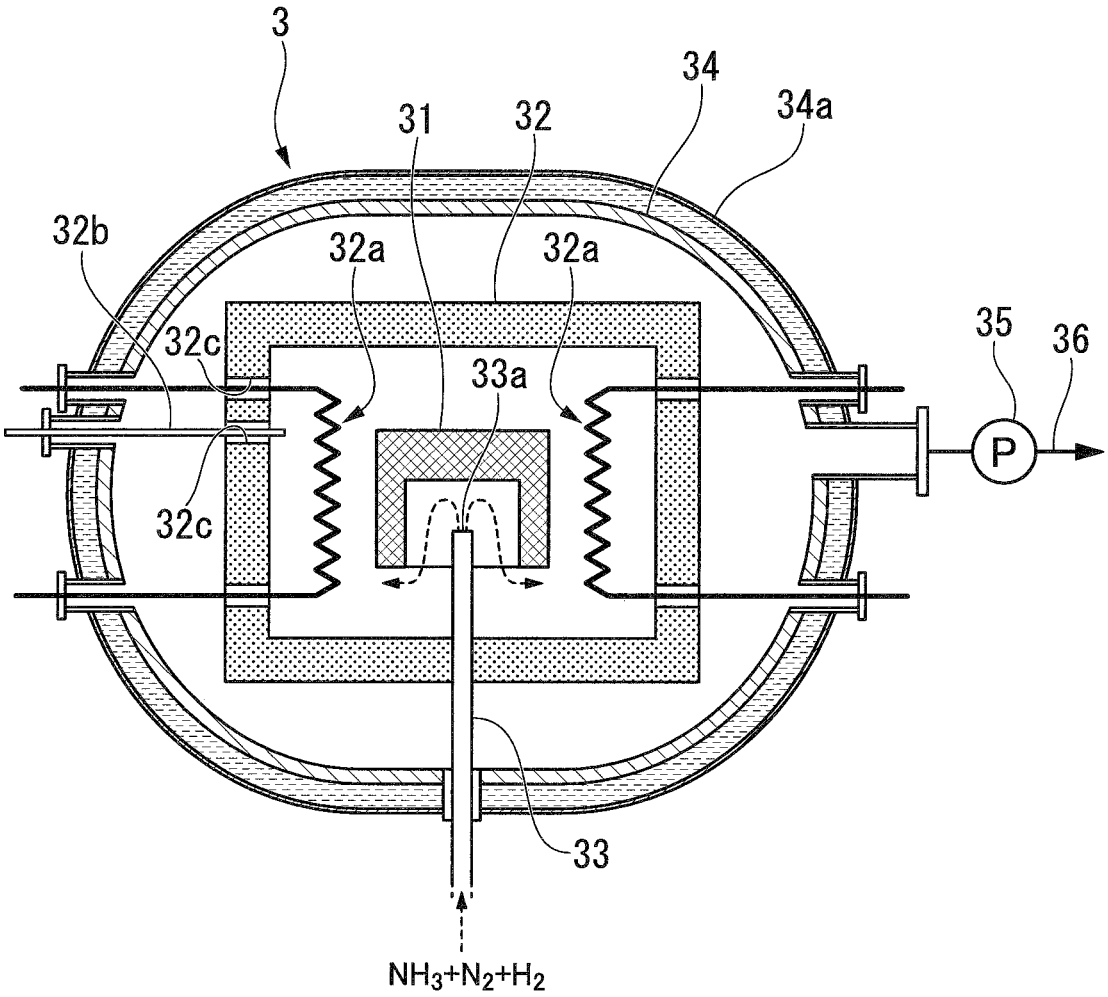
FIG. 3 is a longitudinal sectional view showing a configuration of a thermal decomposition furnace according to the first embodiment of the present disclosure.

FIG. 3 is a longitudinal sectional view showing a configuration of the thermal decomposition furnace 3 according to the first embodiment of the present disclosure.

As shown in FIG. 3, the thermal decomposition furnace 3 of the present embodiment includes a reactant 31, a heating chamber 32, an introduction pipe 33, a vacuum container 34, and a vacuum pump 35.

The reactant 31 functions as a catalyst which promotes a thermal decomposition reaction of the ammonia gas. In the present embodiment, iron is used as the reactant 31. Iron becomes $Fe_4N$ or the like, and promotes the thermal decomposition reaction of the ammonia gas by depriving of nitrogen. For example, the reactant 31 is formed of a steel material.

The reactant 31 is formed in a recessed shape which surrounds a tip 33*a* of the introduction pipe 33. The reactant 31 of the present embodiment is formed in an approximately box shape, and bottom portion of an opening of the reactant 31 is provided so as to face the tip 33*a* of the introduction pipe 33.

The heating chamber 32 accommodates and heats the reactant 31. In the heating chamber 32, a wall portion thereof is formed of a heat insulating material, and the reactant 31 is accommodated inside the wall portion. Moreover, a heater 32*a* and a tip of a thermocouple 32*b* are disposed inside the wall portion of the heating chamber 32. A plurality of through holes 32*c* are provided in the wall portion of the heating chamber 32, and the through holes 32*c* are disposed such that the heater 32*a* and the thermocouple 32*b* penetrate the wall portion of the heating chamber 32. The heater 32*a* and the thermocouple 32*b* control the temperature of the heating chamber 32.

An ammonia gas is introduced into the heating chamber 32 through the introduction pipe 33. As shown in FIG. 1, the introduction pipe 33 is connected to the vacuum pump 11, and the tip 33*a* of the introduction pipe 33 penetrates the wall portion of the heating chamber 32 so as to be inserted to the inside to the heating chamber 32. The ammonia gas transported from the heating furnace 1 is ejected from the tip 33*a* of the introduction pipe 33.

The vacuum container 34 surrounds the heating chamber 32. The vacuum container 34 is formed in a shape having a high pressure resistance, that is, an approximately rounded cylindrical shape. The vacuum container 34 is covered with a water cooling jacket 34*a*.

The vacuum pump 35 evacuates the inside of the vacuum container 34. If the vacuum pump 35 is operated, the gas inside the heating chamber 32 goes out of the heating chamber 32 through the through hole 32*c* and is discharged to the outside of the vacuum container 34.

Return to FIG. 1, an exhaust pipe 36 is provided on the downstream side of the vacuum pump 35.

The nitrogen gas supply device 4 supplies a nitrogen gas to the exhaust pipe 36. The nitrogen gas supply device 4 is provided so as to prevent the gas from being inversely diffused from the downstream side of the vacuum pump 35 to the upstream side of the vacuum pump 35 by supplying the nitrogen gas to the exhaust pipe 36.

Next, an operation of the thermal decomposition furnace 3 having the above-described configuration will be described.

In the thermal decomposition furnace 3, the inside of the vacuum container 34 is evacuated in advance, and the inside of the heating chamber 32 decompresses and enters a vacuum state (extremely low pressure atmosphere). Here, "vacuum" means approximately 1/10 or less of the atmospheric pressure. In the present embodiment, the inside of the heating chamber 32 is a vacuum state of 1 kPa or less, and preferably, 1 Pa or less. Next, power is supplied to the heater 32*a*, and the temperature inside the heating chamber 32 increases to a temperature suitable for the thermal decomposition reaction of the ammonia gas. In the present embodiment, since iron is used as the reactant 31, for example, the temperature inside the heating chamber 32 increases to approximately 850° C.

After the above-described vacuum carburizing/nitriding, the ammonia gas (including nitrogen gas and hydrogen gas) is discharged from the heating furnace 1 shown in FIG. 1. As shown in FIG. 3, the discharged ammonia gas is ejected into the heating chamber 32 from the tip 33*a* of the introduction pipe 33. The ammonia gas is exposed to a high-temperature atmosphere such as 850° C. inside the heating chamber 32 and finally, is thermally decomposed like the following Reaction Formula (1) by the action of the reactant 31.

$$2NH_3 \rightarrow N_2 + 3H_2 \quad (1)$$

Here, the reactant 31 of the present embodiment is formed in a recessed shape which surrounds the tip 33*a* of the introduction pipe 33. According to this configuration, since the ammonia gas ejected from the tip 33*a* of the introduction pipe 33 collides with the bottom surface of the recessed portion of the reactant 31 and thereafter, flows along the side surfaces of the recessed portion, it is possible to secure a long contact distance between the ammonia gas and the reactant 31. Accordingly, the time for the ammonia gas to come into contact with the reactant 31 is prolonged, and it is possible to reliably perform the thermal decomposition of the ammonia gas.

The nitrogen gas and the hydrogen gas which are decomposition gases of the ammonia gas stay in the heating chamber 32 for a predetermined time, and thereafter, go out of the heating chamber 32 through the through hole 32*c* and are discharged to the outside of the vacuum container 34.

The nitrogen gas and the hydrogen gas are discharged to the downstream side exhaust pipe 36 via the vacuum pump 35. Here, as is clear from the Reaction Formula (1), in the decomposition gas of the ammonia gas, concentration of the hydrogen gas tends to be higher than that of the nitrogen gas. Accordingly, the nitrogen gas supply device 4 shown in FIG. 1 supplies a nitrogen gas to the exhaust pipe 36 in order to prevent a combustible hydrogen gas from being inversely diffused from the vacuum pump 35 to the upstream side. Therefore, it is possible to improve stability.

As described above, in the present embodiment, the thermal decomposition furnace 3 is juxtaposed with the heating furnace 1 which performs the vacuum carburizing/nitriding, and after the vacuum carburizing/nitriding, the ammonia gas discharged from the heating furnace 1 is introduced to the thermal decomposition furnace 3, is heated (approximately 850° C.) in a vacuum state, and is thermally decomposed. In the thermal decomposition furnace 3, since the ammonia gas is decomposed by heating, a combustion waste gas is not discharged, and water for treating the ammonia gas is not required and replacement or replenishment of an absorbent or the like is not required. Therefore, according to the present embodiment, it is possible to inexpensively perform the treatment of the ammonia gas.

In this way, according to the vacuum carburizing device A of the above-described present embodiment, since the vacuum carburizing device A includes the heating furnace 1 which heats the workpiece W, the ammonia gas supply device 2 which supplies the ammonia gas which nitrides the workpiece W to the heating furnace 1, and the thermal decomposition furnace 3 which thermally decomposes the ammonia gas discharged from the heating furnace 1 after the nitriding, it is possible to inexpensively perform the treatment of the ammonia gas.

Second Embodiment

Next, a second embodiment of the present disclosure will be described. In the following descriptions, the same reference numerals are assigned to configurations which are the same as or equivalent to those of the above-described embodiment, and descriptions thereof are simplified or omitted.

Figure 4A:
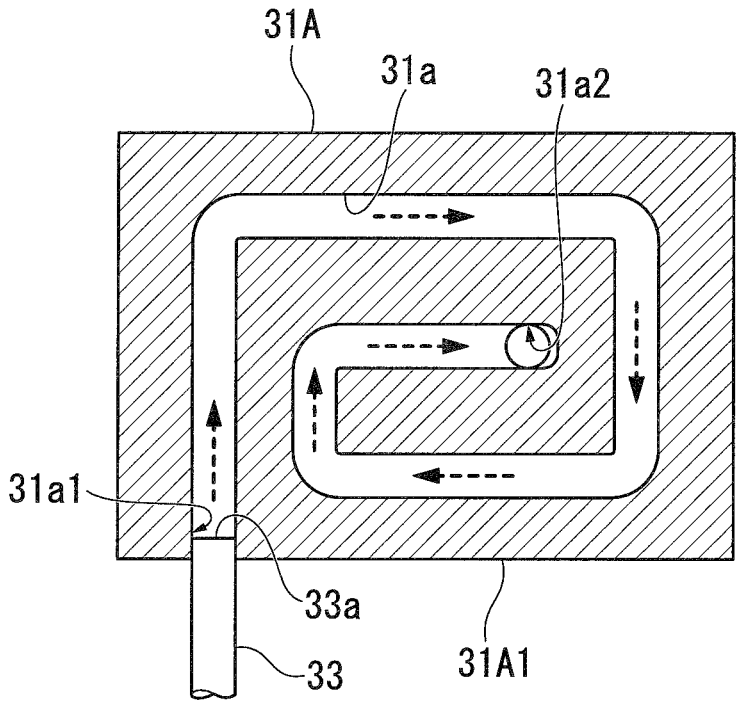
FIG. 4A is a longitudinal sectional view of a reactant according to a second embodiment of the present disclosure.
Figure 4B:
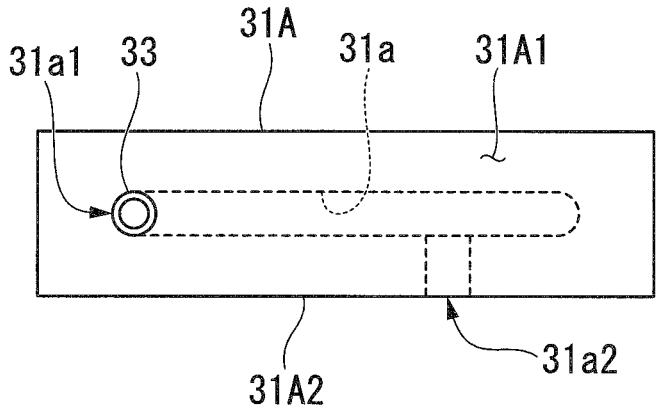
FIG. 4B is a bottom view of the reactant according to the second embodiment of the present disclosure.

FIGS. 4A and 4B are views showing a configuration of a reactant 31A according to the second embodiment of the present disclosure. FIG. 4A is a longitudinal sectional view of the reactant 31A and FIG. 4B is a bottom view of the reactant 31A.

As shown in FIGS. 4A and 4B, the reactant 31A of the second embodiment is different from the above-described embodiment in that a flow passage 31*a* is provided inside the reactant 31A.

The reactant 31A is formed in a block shape, a first end 31*a*1 of the flow passage 31*a* is open to a block bottom surface 31A1, and a second end 31*a*2 of the flow passage 31*a* is open to a block back surface 31A2 of the reactant 31A. The flow passage 31*a* is formed in a spiral shape from the first end 31*a*1 toward the second end 31*a*2. The tip 33*a* of the introduction pipe 33 is connected to the first end 31*a*1 of the flow passage 31*a*.

According to the second embodiment having the above-de'scribed configuration, an ammonia gas ejected from the tip 33*a* of the introduction pipe 33 flows from the first end 31*a*1 of the flow passage 31*a* toward a second end 31*a*2 thereof. Since wall surfaces forming the flow passage 31*a* are configured of the reactant 31A and the flow passage 31*a* is formed in a spiral shape, it is possible to obtain a long contact distance between the ammonia gas and the reactant 31. In this way, in the second embodiment, the time for the ammonia gas to come into contact with the reactant 31 is prolonged, and it is possible to reliably perform the thermal decomposition of the ammonia gas.

Third Embodiment

Next, a third embodiment of the present disclosure will be described. In the following descriptions, the same reference numerals are assigned to configurations which are the same as or equivalent to those of the above-described embodiments, and descriptions thereof are simplified or omitted.

Figure 5A:
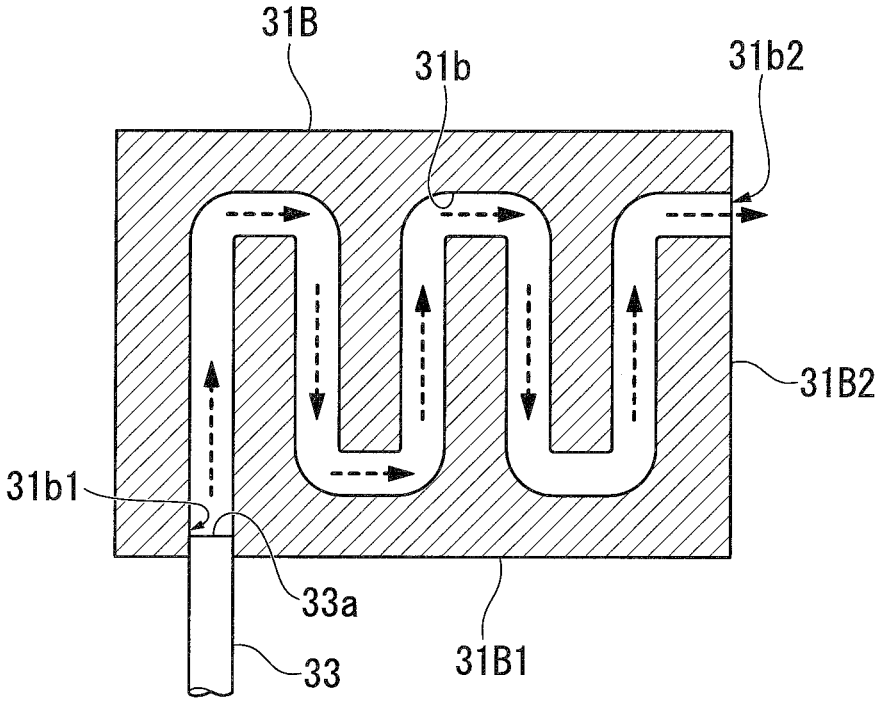
FIG. 5A is a longitudinal sectional view of a reactant according to a third embodiment of the present disclosure.
Figure 5B:
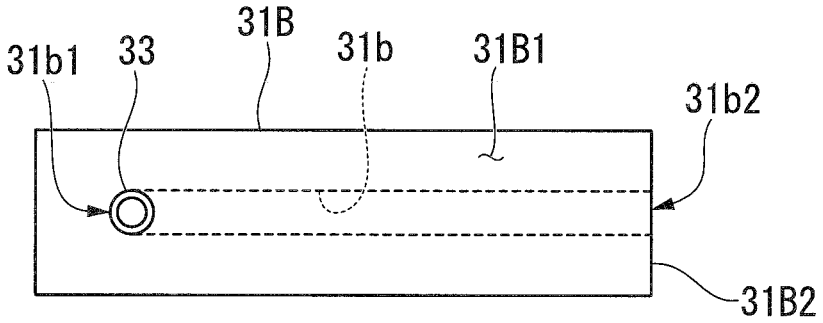
FIG. 5B is a bottom view of the reactant according to the third embodiment of the present disclosure.

FIGS. 5A and 5B are views showing a configuration of a reactant 31B according to the third embodiment of the present disclosure. FIG. 5A is a longitudinal sectional view of the reactant 31B and FIG. 5B is a bottom view of the reactant 31B.

As shown in FIGS. 5A and 5B, the reactant 31B of the third embodiment is different from the above-described embodiments in that a flow passage 31*b* is provided inside the reactant 31B.

The reactant 31B is formed in a block shape, a first end 31*b*1 of the flow passage 31*b* is open to a block bottom surface 31B1, and a second end 31*b*2 of the flow passage 31*b* is open to a block side surface 31B2 of the reactant 31B. The flow passage 31*b* is formed in a zigzag shape from the first end 31*b*1 toward the second end 31*b*2. The tip 33*a* of the introduction pipe 33 is connected to the first end 31*b*1 of the flow passage 31*b*.

According to the third embodiment having the above-described configuration, an ammonia gas ejected from the tip 33*a* of the introduction pipe 33 flows from the first end 31*b*1 of the flow passage 31*b* toward a second end 31*b*2 thereof. Since wall surfaces forming the flow passage 31*b* are configured of the reactant 31B and the flow passage 31*b* is formed in a zigzag shape, it is possible to obtain a long contact distance between the ammonia gas and the reactant 31. In this way, in the third embodiment, the time for the ammonia gas to come into contact with the reactant 31 is prolonged, and it is possible to reliably perform the thermal decomposition of the ammonia gas.

In addition, the present disclosure is not limited to the above-described embodiments, and for example, the following modification examples may be considered.

(1) In the second embodiment and the third embodiment, the configurations in which the reactants include the flow passages formed in a spiral shape or a zigzag shape are described. However, the present disclosure is not limited to this. For example, other complicated labyrinth structures may be used, except for difficulty in manufacturing of the flow passage. In addition, the structure of the reactant may be appropriately divided according to the complexity of the flow passage.

(2) In addition, the above-described embodiments describe that the vacuum carburizing/nitriding are performed in the heating furnace. However, the present disclosure is not limited to this. For example, only nitriding may be performed in the heating furnace.

INDUSTRIAL APPLICABILITY

According to the present disclosure, it is possible to provide a vacuum carburizing device which can inexpensively treat an ammonia gas used in nitriding.

What is claimed is:

1. A heat treating device, comprising:

a heating furnace which heats a workpiece;

an ammonia gas supply device which supplies an ammonia gas to the heating furnace which nitrides the workpiece in the heating furnace; and a thermal decomposition furnace which thermally decomposes the ammonia gas discharged from the heating furnace after the nitriding, wherein the thermal decomposition furnace includes:

a reactant which promotes a thermal decomposition reaction of the ammonia gas, a heating chamber which accommodates and heats the reactant, an introduction pipe through which the ammonia gas is introduced to the heating chamber, a vacuum container which surrounds the heating chamber, and a vacuum pump which evacuates the inside of the vacuum container.

2. The heat treating device according to claim 1, further comprising:

an exhaust pipe which is provided on the downstream side of the vacuum pump; and a nitrogen gas supply device which supplies a nitrogen gas to the exhaust pipe.

3. The heat treating device according to claim 1, wherein the reactant is formed in a recessed shape which surrounds a tip of the introduction pipe.

4. The heat treating device according to claim 3, further comprising:

an exhaust pipe which is provided on the downstream side of the vacuum pump; and a nitrogen gas supply device which supplies a nitrogen gas to the exhaust pipe.

5. The heat treating device according to claim 1, wherein the reactant includes a flow passage inside the reactant, and wherein a tip of the introduction pipe is connected to the flow passage.

6. The heat treating device according to claim 5, wherein the flow passage is formed in a spiral shape.

7. The heat treating device according to claim 6, further comprising:

an exhaust pipe which is provided on the downstream side of the vacuum pump; and a nitrogen gas supply device which supplies a nitrogen gas to the exhaust pipe.

8. The heat treating device according to claim 5, wherein the flow passage is formed in a zigzag shape.

9. The heat treating device according to claim 8, further comprising:

an exhaust pipe which is provided on the downstream side of the vacuum pump; and a nitrogen gas supply device which supplies a nitrogen gas to the exhaust pipe.

10. The heat treating device according to claim 5, further comprising:

an exhaust pipe which is provided on the downstream side of the vacuum pump; and a nitrogen gas supply device which supplies a nitrogen gas to the exhaust pipe.

* * * * *